US006814050B2

(12) United States Patent
Kishibata et al.

(10) Patent No.: US 6,814,050 B2
(45) Date of Patent: Nov. 9, 2004

(54) FUEL CUT CONTROL DEVICE FOR INTERNAL COMBUSTION ENGINE

(75) Inventors: Kazuyoshi Kishibata, Numzau (JP); Yuichi Kitagawa, Numazu (JP); Hiroyasu Sato, Numazu (JP); Akira Shimoyama, Numazu (JP)

(73) Assignee: Kokusan Denki Co., Ltd., Shizuoka-ken (JP)

( * ) Notice: Subject to any disclaimer, the term of this patent is extended or adjusted under 35 U.S.C. 154(b) by 0 days.

(21) Appl. No.: 10/706,785

(22) Filed: Nov. 12, 2003

(65) Prior Publication Data

US 2004/0094120 A1 May 20, 2004

(30) Foreign Application Priority Data

Nov. 15, 2002 (JP) ..... 2002-331647

(51) Int. Cl.[7] ..... F02P 9/00
(52) U.S. Cl. ..... 123/332; 123/333; 123/198 DB
(58) Field of Search ..... 123/332, 333, 123/395, 344, 198 DB, 319

(56) References Cited

U.S. PATENT DOCUMENTS 4,621,600 A * 11/1986 Hasegawa ..... 123/357
4,989,562 A * 2/1991 Ohkumo et al. ..... 123/198 D

FOREIGN PATENT DOCUMENTS

| | | |
|---|---|---|
| JP | 10-339187 | 12/1998 |
| JP | 2002-213289 | 7/2002 |

* cited by examiner

*Primary Examiner*—Bibhu Mohanty
(74) *Attorney, Agent, or Firm*—Pearne & Gordon LLP

(57) ABSTRACT

A fuel cut control device that stops supply of fuel to an internal combustion engine during deceleration of the internal combustion engine having a throttle valve for each cylinder, which detects a maximum value of an intake pipe pressure during one combustion cycle of the internal combustion engine, starts fuel cut control when it is detected that the detected maximum value of the intake pipe pressure becomes less than a set fuel cut start determination value, and stop the fuel cut control when it is detected that the detected maximum value of the intake pipe pressure exceeds a fuel supply restart determination value set higher than the fuel cut start determination value to restart the supply of the fuel to the internal combustion engine.

9 Claims, 8 Drawing Sheets

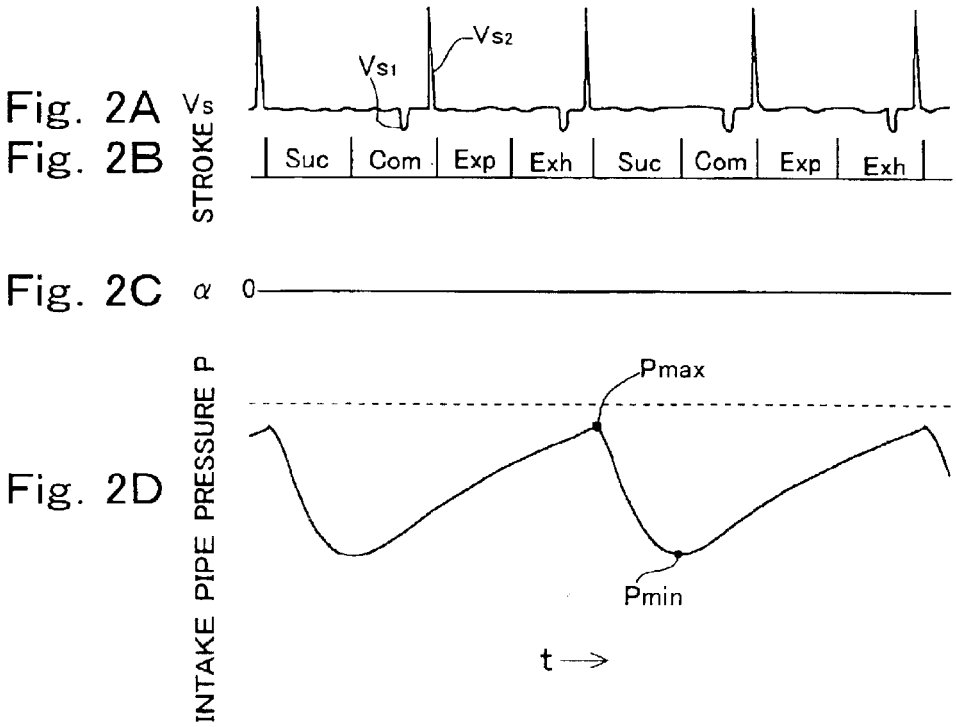
Fig. 8
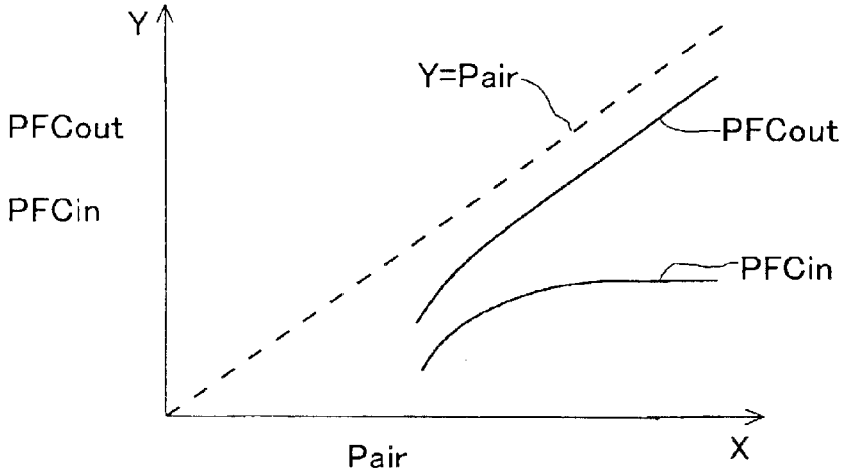

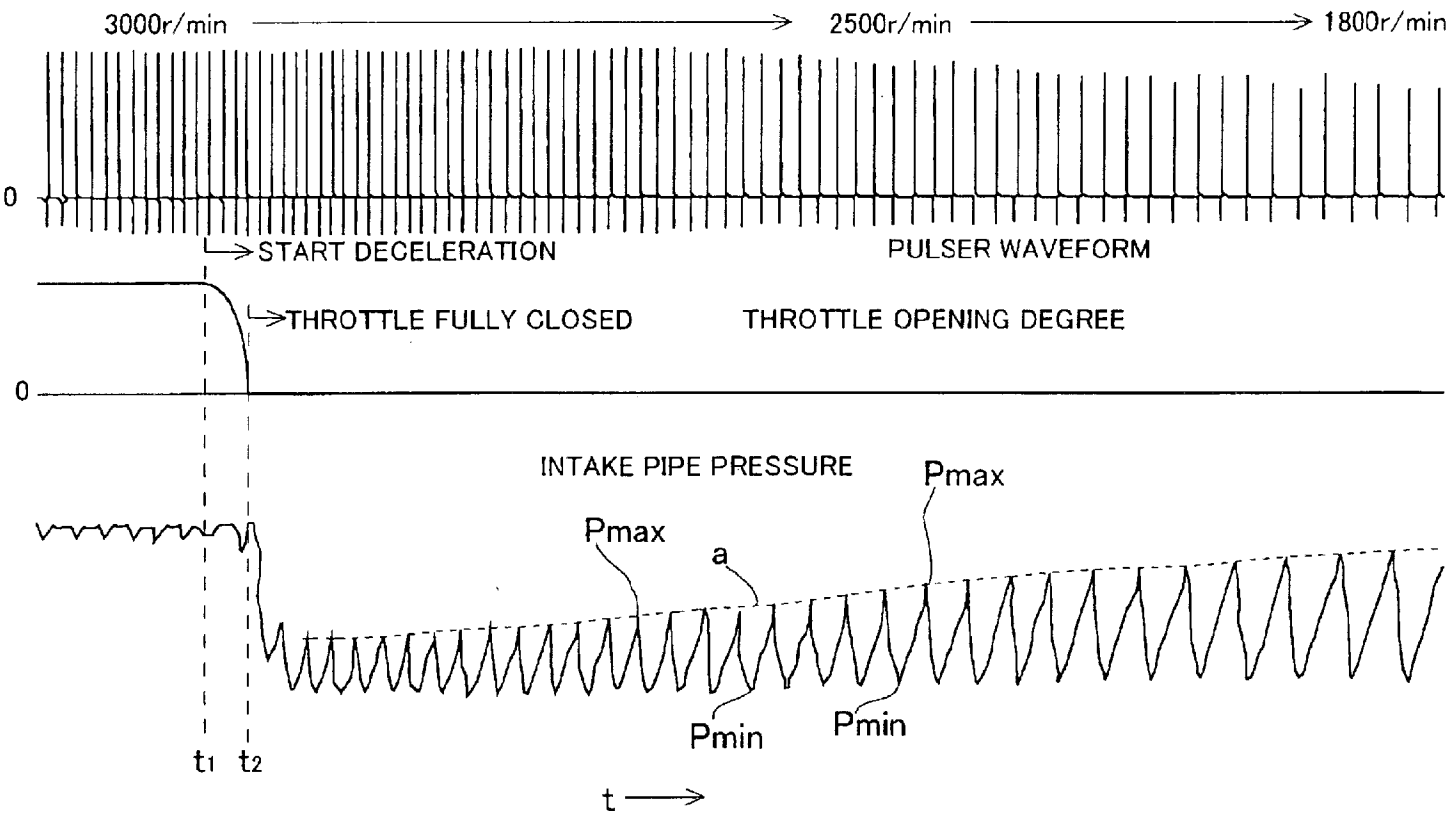
Fig. 3A Vs
Fig. 3B α
Fig. 3C P

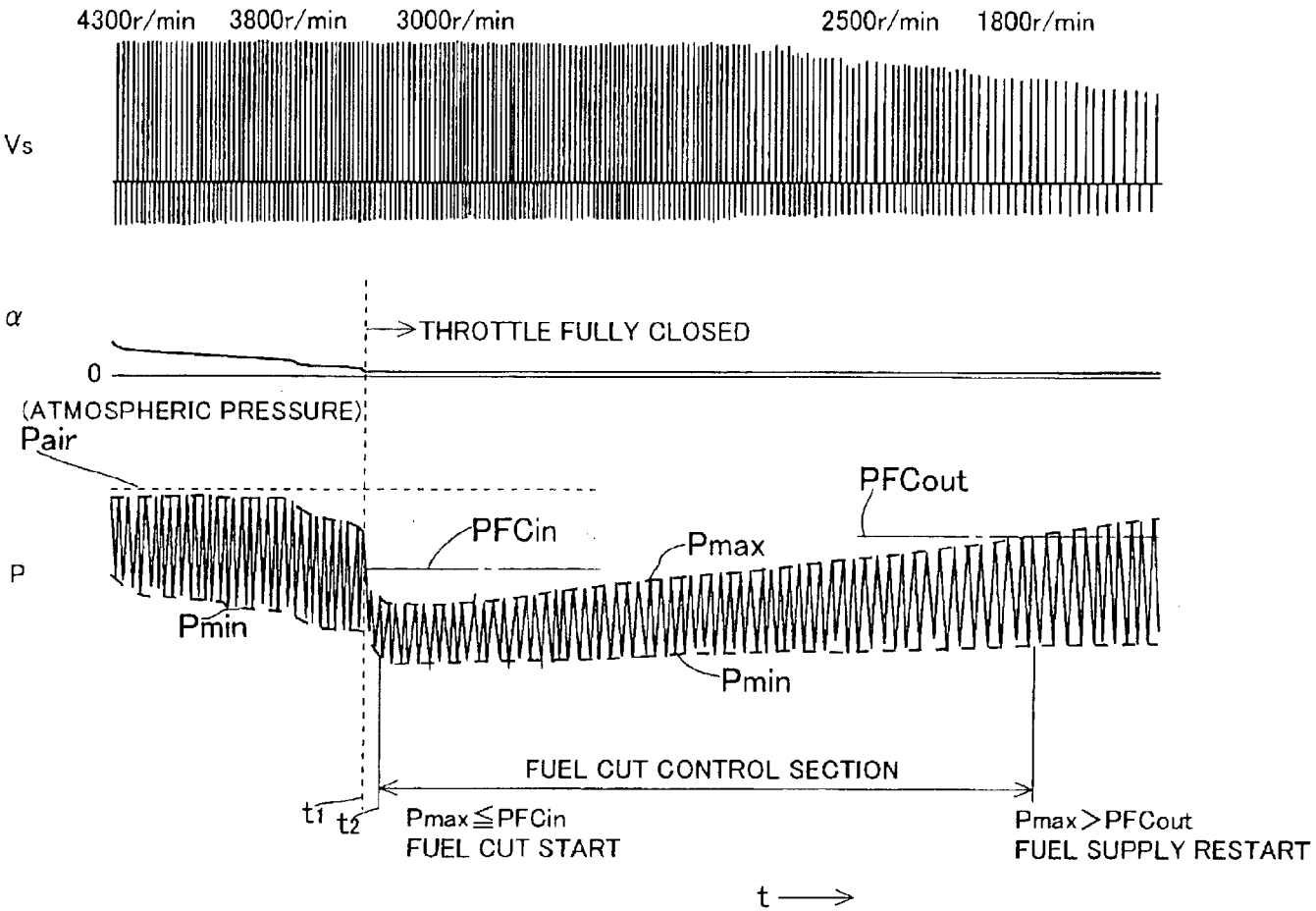
Fig. 4A Vs
Fig. 4B α
Fig. 4C P

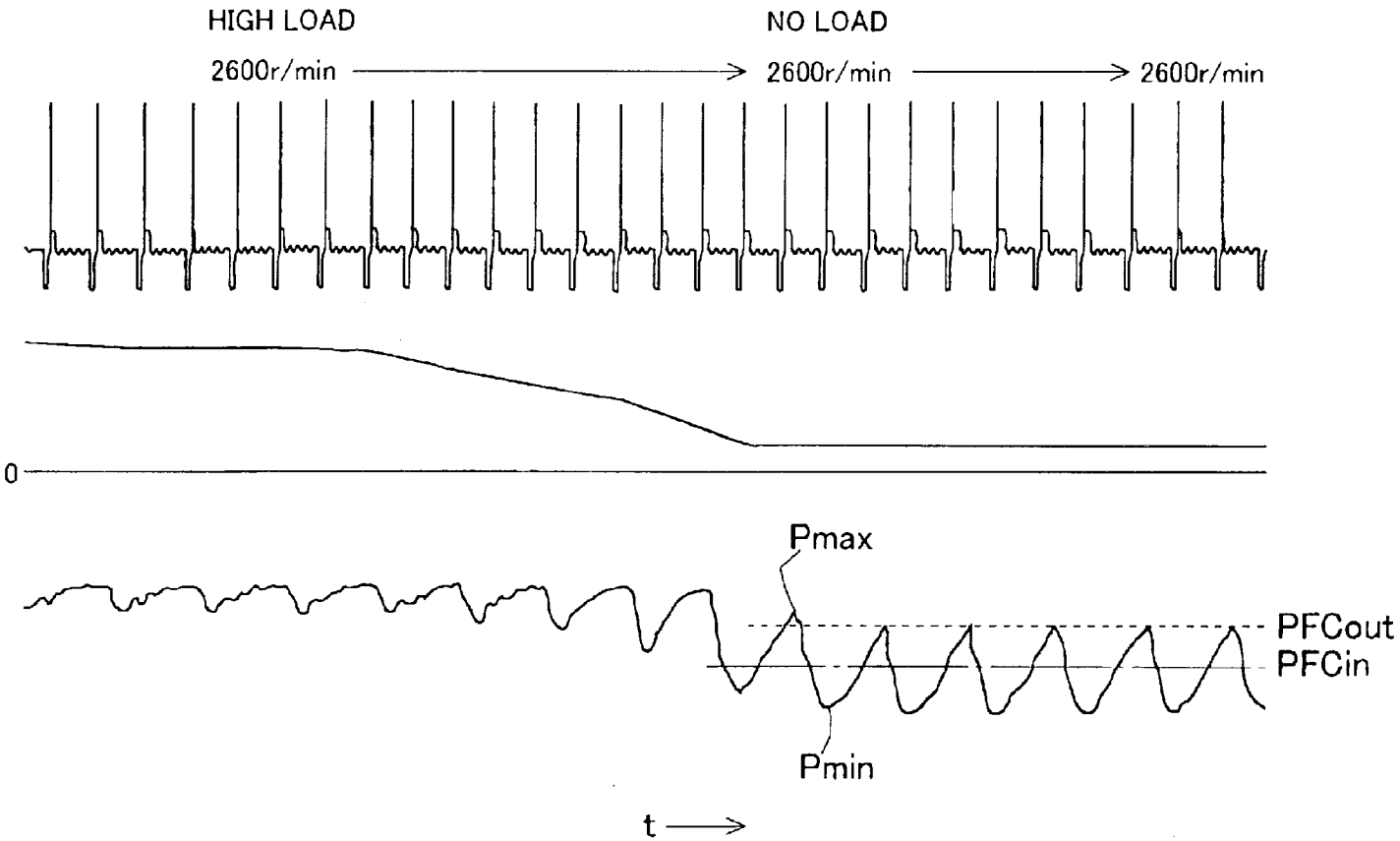
Fig. 5A $V_s$
Fig. 5B $\alpha$
Fig. 5C P

Fig. 9
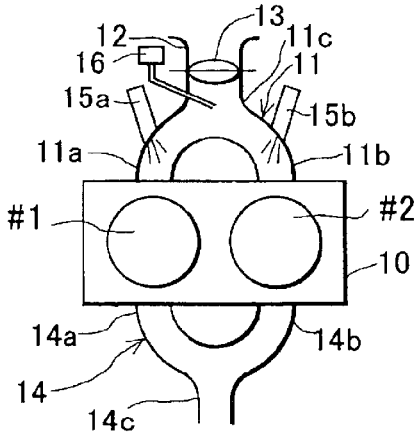
Fig. 10A
Fig. 10B
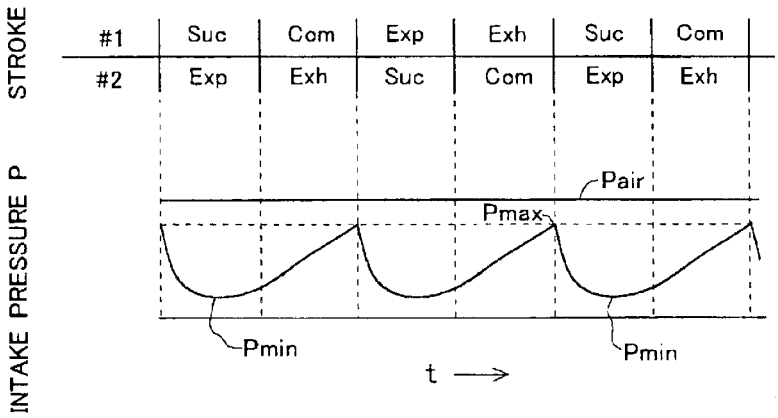

FUEL CUT CONTROL DEVICE FOR INTERNAL COMBUSTION ENGINE

TECHNICAL FIELD OF THE INVENTION

The present invention relates to a fuel cut control device for an internal combustion engine that controls and cuts fuel during deceleration of a four-cycle internal combustion engine.

BACKGROUND OF THE INVENTION

In order to improve fuel economy of an internal combustion engine or to clean exhaust gas, fuel cut control is performed to stop supply of fuel during deceleration of the engine.

As described in Japanese Patent Laid-Open Nos. 10-339187 and 2002-213289, a conventional control device having a capability of fuel cut control includes a throttle sensor that detects an opening degree of a throttle valve, and stops supply of fuel when an engine rotates at a higher rotational speed than a predetermined rotational speed in a state where the sensor detects that the throttle valve is closed.

The state where the throttle valve is closed is a state where a load of the engine is low (a deceleration state), and a state where the engine rotates at a high rotational speed though the engine is in the low load state is a state where the engine is rotated by an external force. In this state, the engine does not need to generate an output, and thus fuel cut control can be performed.

Performing the fuel cut control when the engine does not need to generate the output saves fuel consumption, and also reduces the amount of hazardous exhaust gas because unnecessary combustion is avoided.

As described above, the conventional fuel cut control device requires detection of the opening degree of the throttle valve, which requires an expensive throttle sensor to inevitably increase the cost of the control device.

SUMMARY OF THE INVENTION

Thus, an object of the invention is to provide a fuel cut control device for an internal combustion engine that detects a low load state of the internal combustion engine without using an expensive throttle sensor, and properly performs fuel cut control during deceleration of the internal combustion engine.

The invention is applied to a fuel cut control device for an internal combustion engine including a controller that performs fuel cut control to stop supply of fuel to the internal combustion engine during deceleration of a single-cylinder or multi-cylinder internal combustion engine having a throttle valve for each cylinder, or a multi-cylinder internal combustion engine having one throttle valve for two cylinders.

In the invention, "multi-cylinder internal combustion engine" means an internal combustion engine having two or more cylinders.

In the invention, the controller is comprised so as to detect a maximum value of an intake pipe pressure during one combustion cycle of the internal combustion engine, start the fuel cut control when it is detected that the detected maximum value of the intake pipe pressure becomes less than a set fuel cut start determination value, and stop the fuel cut control when it is detected that the detected maximum value of the intake pipe pressure exceeds a fuel supply restart determination value set higher than the fuel cut start determination value to restart the supply of the fuel to the internal combustion engine.

The controller may includes: an intake pipe pressure maximum value detection unit that detects the maximum value of the intake pipe pressure during one combustion cycle of the internal combustion engine; a fuel cut/restart timing detection unit that detects a timing when the maximum value of the intake pipe pressure detected by the intake pipe pressure maximum value detection unit becomes less than the set fuel cut start determination value, as fuel cut control start timing when the fuel cut control is started, and detects a timing when the maximum value of the intake pipe pressure detected by the intake pipe pressure maximum value detection unit exceeds the fuel supply restart determination value set higher than the fuel cut start determination value, as fuel supply restart timing when the fuel cut control is stopped to restart the supply of the fuel to the internal combustion engine; and a fuel supply control unit that controls the supply of the fuel to the internal combustion engine so as to start the fuel cut control when the fuel cut/restart timing detection unit detects the fuel cut control start timing, and restart the supply of the fuel to the internal combustion engine when the fuel supply restart timing is detected.

In a single-cylinder or multi-cylinder four-cycle internal combustion engine having a throttle valve for each cylinder, a change in the maximum value of the intake pipe pressure that occurs during one combustion cycle reflects a load state of the engine, and thus if an appropriate fuel cut start determination value and an appropriate fuel supply restart determination value are set with respect to the maximum value of the intake pipe pressure that occurs during one combustion cycle, the intake pipe pressure becomes less than the fuel cut start determination value when the engine decelerates, and the intake pipe pressure reaches above the fuel supply restart determination value when a rotational speed of the engine decreases to the extent that the supply of the fuel needs to be restarted.

Therefore, the fuel cut start determination value and the fuel supply restart determination value are appropriately set, the fuel cut control is started at the timing when the maximum value of the intake pipe pressure becomes less than the fuel cut start determination value, and the supply of the fuel is restarted at the timing when the maximum value of the intake pipe pressure reaches above the fuel supply restart determination value, thereby allowing proper fuel cut control without detecting an opening degree of the throttle valve.

In a multi-cylinder four-cycle internal combustion engine having one throttle valve for two cylinders, the intake pipe pressure represents a maximum value immediately before one of the two cylinders enters a suction stroke, and the intake pipe pressure represents a minimum value before the suction stroke of one of the cylinders finishes.

Therefore, also in the multi-cylinder internal combustion engine having one throttle valve for two cylinders, the fuel cut start determination value and the fuel supply restart determination value are appropriately set, the fuel cut control is started at the timing when the maximum value of the intake pipe pressure becomes less than the fuel cut start determination value, and the supply of the fuel is restarted at the timing when the maximum value of the intake pipe pressure reaches above the fuel supply restart determination value, thereby allowing proper fuel cut control without detecting an opening degree of the throttle valve.

In the case where a vehicle drives on uplands, if the fuel cut start determination value and the fuel supply restart determination value are set to fixed values appropriate for lowland driving when the above described control is performed, a difference between the atmospheric pressure and the fuel cut start determination value decreases during highland driving to cause frequent fuel cut control leading to an unstable operation of the engine, since the atmospheric pressure is reduced on uplands. If the atmospheric pressure becomes equal to or lower than the fuel supply restart determination value, the supply of the fuel cannot be restarted, and the engine stalls.

In order to prevent such a problem, in a preferred aspect of the invention, the controller further includes: an atmospheric pressure measurement unit that measures atmospheric pressure or an atmospheric pressure estimation unit that estimates the atmospheric pressure from the intake pipe pressure; and determination value deciding means that decides the fuel cut start determination value and the fuel supply restart determination value depending on an atmospheric pressure value obtained by the atmospheric pressure measurement unit or the atmospheric pressure estimation unit.

BRIEF DESCRIPTION OF THE DRAWINGS

The above and other objects and features of the invention will be apparent from the detailed description of the preferred embodiments of the invention, which are described and illustrated with reference to the accompanying drawings, in which;

FIGS. 2A to 2D are time charts showing a waveform of a signal obtained from a pulser, a stroke change of an internal combustion engine, a change in throttle valve opening degree, and a change in intake pipe pressure with respect to time, when the internal combustion engine is idling, in the device in FIG. 1;

FIGS. 3A to 3C are time charts showing a pulser output waveform, a change in throttle valve opening degree, and a change in intake pipe pressure with respect to time, when the internal combustion engine is decelerated by changing a position of a throttle valve to a fully-closed position from a high speed rotation state with a load applied on the internal combustion engine, in the device in FIG. 1;

FIGS. 4A to 4C are time charts showing a pulser output waveform, a change in throttle valve opening degree, and a change in intake pipe pressure with respect to time, when the internal combustion engine is decelerated by changing the position of the throttle valve to the fully-closed position from the high speed rotation state with the load applied on the internal combustion engine while a vehicle is driving, in the device in FIG. 1;

FIGS. 5A to 5C are time charts showing a pulser output waveform, a change in throttle valve opening degree, and a change in intake pipe pressure with respect to time, when an internal combustion engine is decelerated by changing the position of the throttle valve to a position slightly before the fully-closed position from the high speed rotation state with the load applied on the internal combustion engine, in the device in FIG. 1;

FIG. 8 is a graph of an embodiment of a relationship between the fuel cut start determination value and the fuel supply restart determination value and the atmospheric pressure, when the fuel cut start determination value and the fuel supply restart determination value are arithmetically operated depending on the atmospheric pressure;

FIG. 9 is a schematic top view of a construction of an internal combustion engine having one throttle valve for two cylinders; and FIGS. 10A and 10B are graphs of a relationship between stroke changes and an intake pipe pressure of the two cylinders of the internal combustion engine in FIG. 9.

DETAILED DESCRIPTION OF PREFERRED EMBODIMENTS

Preferred embodiments of the present invention will be hereinafter described with reference to the accompanying drawings.

Figure 1:
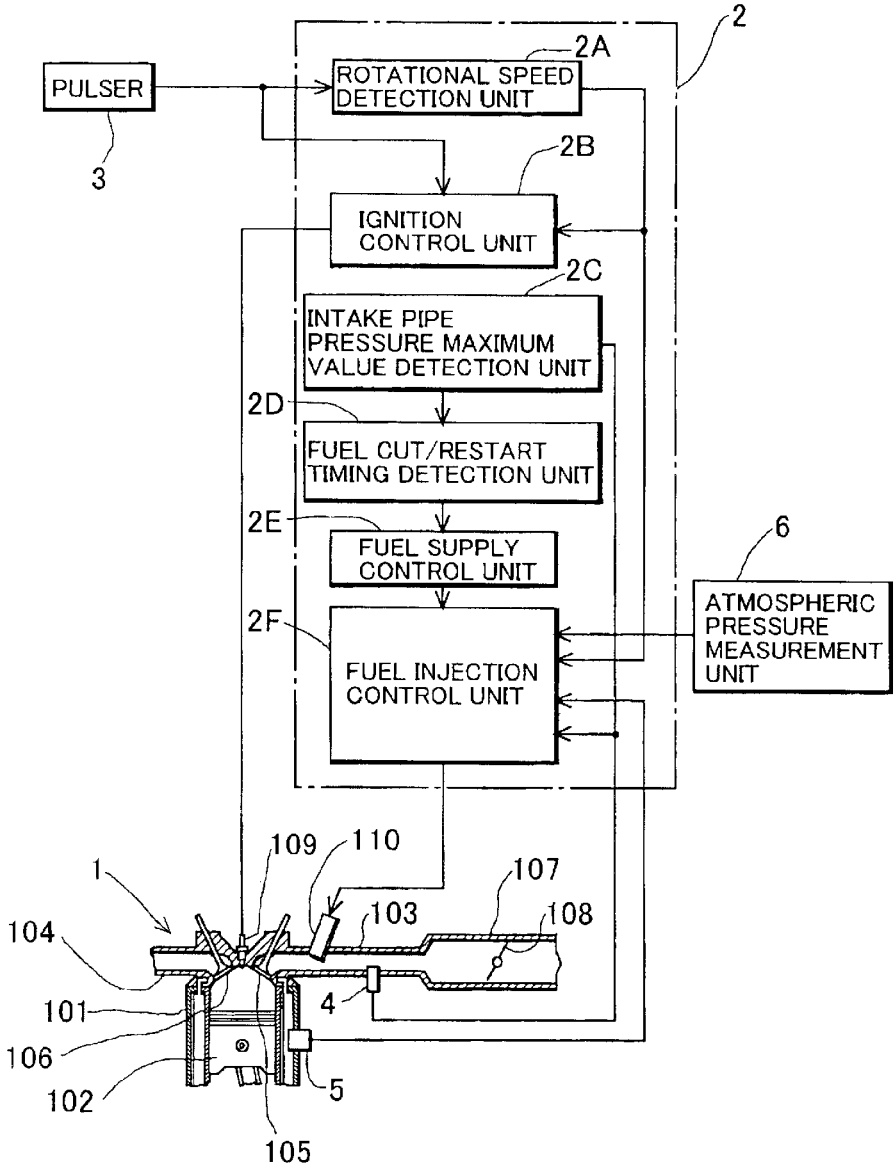
FIG. 1 is a block diagram of an embodiment of an entire construction of a control device according to the invention.

FIG. 1 shows a construction embodiment of a hardware of a control device according to the present invention. In FIG. 1, a reference numeral 1 denotes a single-cylinder four-cycle internal combustion engine that drives a vehicle. The internal combustion engine 1 includes a cylinder 101, a piston 102 provided in the cylinder, an intake pipe 103 and an exhaust pipe 104 connected to an intake port and an exhaust port, respectively, provided in the cylinder 101, an intake valve 105 that opens/closes the intake port, an exhaust valve 106 that opens/closes the exhaust port, a throttle body 107 connected to the intake pipe 103, and a throttle valve 108 provided in the throttle body 107. An ignition plug 109 is mounted to a head of the cylinder, and a fuel injector (an electromagnetic fuel injection valve) 110 is mounted to the intake pipe 103.

Fuel is supplied to the injector 110 from an unshown fuel tank via a fuel pump. A pressure of the fuel supplied to the injector 110 is kept constant by a pressure regulator, and the amount of fuel injected from the injector 110 is controlled by the time for the injector to inject the fuel (an injection time).

A reference numeral 2 denotes a controller having a microprocessor. The controller 2 includes a rotational speed detection unit 2A, an ignition control unit 2B, an intake pipe pressure maximum value detection unit 2C, a fuel cut/restart timing detection unit 2D, a fuel supply control unit 2E, and a fuel injection control unit 2F. The rotational speed detection unit 2A, the ignition control unit 2B, the intake pipe pressure maximum value detection unit 2C, the fuel cut/restart timing detection unit 2D, the fuel supply control unit 2E, and the fuel injection control unit 2F are constituted by the microprocessor executing a predetermined program or by a hardware circuit.

The rotational speed detection unit 2A detects a rotational speed of the engine from an output of a pulser (pulse signal generator) 3 that is mounted to the engine and generates pulse signals at a fixed crank angle position. The rotational speed detection unit 2A is comprised of a waveform shaping circuit that converts an output waveform of the pulser 3 into a waveform that can be recognized by the microprocessor, a timer that measures an interval between pulses output by the pulser 3, and means for arithmetically operating the rotational speed of the engine from a time measured by the timer.

The ignition control unit 2B applies a high voltage for ignition to an ignition plug 109 when the engine is ignited.

The ignition control unit 2B is comprised of, for example, ignition timing arithmetical operation means that arithmetically operates an ignition timing of the engine with respect to the rotational speed detected by the rotational speed detection unit 2A, ignition timing detection means that causes an ignition timer to perform a measurement operation for detecting the ignition timing arithmetically operated by the ignition timing arithmetical operation means with reference to a timing when the pulser 3 generates a predetermined pulse, and generates an ignition signal when the ignition timer completes the measurement operation for detecting the ignition timing, and an ignition circuit that generates the high voltage to be applied to the ignition plug 109 when the ignition signal is generated. Among the components of the ignition control unit 2B, components other than the ignition circuit are constituted by the microprocessor executing a predetermined program.

The intake pipe pressure maximum value detection unit 2C detects a maximum value Pmax of an intake pipe pressure during one combustion cycle. The intake pipe pressure maximum value detection unit 2C samples an output of an intake pressure sensor 4 mounted to the intake pipe 103 at a fixed time interval and compares intake pipe pressures successively sampled during one combustion cycle to calculate the maximum value Pmax of the intake pipe pressure sampled during one combustion cycle.

The fuel cut/restart timing detection unit 2D detects a timing when the maximum value Pmax of the intake pipe pressure during one combustion cycle detected by the intake pipe pressure maximum value detection unit 2C becomes less than a set fuel cut start determination value PFCin, as a fuel cut control start timing when fuel cut control is started, and detects a timing when the maximum value Pmax of the intake pipe pressure detected by the intake pipe pressure maximum value detection unit exceeds a fuel supply restart determination value PFCout set higher than the fuel cut start determination value PFCin, as a fuel supply restart timing when the fuel cut control is stopped to restart the supply of the fuel to the internal combustion engine.

The fuel supply control unit 2E controls the supply of the fuel to the internal combustion engine so as to start the fuel cut control when the fuel cut/restart timing detection unit 2D detects the fuel cut control start timing, and restart the supply of the fuel to the internal combustion engine when the fuel supply restart timing is detected. The fuel supply control unit 2E provides a fuel cut instruction to the fuel injection control unit 2F when the fuel cut/restart timing detection unit 2D detects the fuel cut control start timing to start the fuel cut control, and provides a fuel supply instruction to the fuel injection control unit 2F when the fuel cut/restart timing detection unit 2D detects the fuel supply restart timing to restart the supply of the fuel to the internal combustion engine.

The fuel injection control unit 2F arithmetically operates the injection time (the time for the injector to inject the fuel) required for the fuel of an amount decided by various control conditions to be injected from the injector 110, and controls the injector 110 so as to inject the fuel during the arithmetically operated injection time at a predetermined injection timing. The fuel injection control unit 2F is comprised so as to stop a control operation to stop the injection of the fuel from the injector 110 when the fuel cut instruction is provided, and allow the control operation of injecting the fuel from the injector 110 during the arithmetically operated injection time when the fuel supply instruction is provided.

In the shown embodiment, the fuel injection control unit 2F uses a speed density method as a method for estimating the amount of entering air. Thus, the fuel injection control unit 2F includes entering air amount estimation means that estimates the amount of air entering the intake pipe from the rotational speed of the internal combustion engine detected by the rotational speed detection unit 2A and the intake pipe pressure detected by the intake pressure sensor 4, basic injection time arithmetical operation means that arithmetically operates a basic injection time of the fuel required for obtaining an air-fuel mixture having a predetermined air/fuel ratio with respect to the amount of air estimated by the estimation means, and injection time correction means that corrects the basic injection time with respect to atmospheric pressure detected by an atmospheric pressure sensor 6 or a temperature of cooling water of the internal combustion engine detected by a water temperature sensor 5 to arithmetically operates an actual injection time. When the fuel supply instruction is provided from the fuel supply control unit 2E, the fuel injection control unit provides a drive current to the injector 110 from an unshown injector drive circuit to perform a fuel injection operation during the arithmetically operated actual injection time.

In the single-cylinder four-cycle internal combustion engine in FIG. 1, when an opening degree $\alpha$ of the throttle valve 108 is substantially in a fully-closed state, and the engine is idling as shown in FIG. 2C, a pressure P in the intake pipe 103 changes with respect to time t as shown in FIG. 2D.

FIG. 2A shows a waveform of an output Vs of the pulser 3. The pulser 3 generates a first pulse Vs1 at a sufficiently advanced timing as compared with a timing when the piston of the engine reaches top dead center, and generates a second pulse Vs2 at a slightly advanced timing as compared with the timing when the piston reaches top dead center.

FIG. 2B shows a stroke change of the engine, and "Suc", "Com", "Exp", and "Exh" represent "suction stroke", "compression stroke", "expansion stroke" and "exhaust stroke", respectively.

While the engine is idling, the intake pipe pressure P rapidly decreases when the combustion cycle of the engine enters the suction stroke. The decrease in the pressure continues until the suction stroke finishes. After the suction stroke finishes, a differential pressure between atmospheric pressure upstream of the throttle valve 108 and a high negative pressure (a state where the atmospheric pressure is extremely low) in the intake pipe causes air to flow through a slight gap between the throttle valve 108 and the throttle body 107 to gradually increase the intake pipe pressure. Before the intake pipe pressure reaches the atmospheric pressure, the next suction stroke is started, and the intake pipe pressure rapidly decreases again. Thus, in the idling state, the intake pipe pressure P represents the maximum value Pmax immediately before the suction stroke, and represents a minimum value Pmin at a timing when the suction stroke finishes.

FIGS. 3A to 3C show a pulser output waveform, a change in the throttle valve opening degree $\alpha$, and a waveform of the intake pipe pressure P with respect to the time t, when the engine decelerates from a loaded state.

In a high speed rotation state with a load applied on the engine, as shown in the left end of FIG. 3B, the throttle valve is opened, and a large amount of air flows through the throttle valve to supply a sufficient amount of air into the intake pipe even in the suction stroke. Thus, in the high speed rotation state with the load applied on the engine, the intake pipe pressure does not decrease unlike during a low load state, and after the suction stroke finishes, the intake pipe pressure immediately increases near the atmospheric pressure. When deceleration is started (closing of the throttle valve is started) at time t1 in this state, and the throttle valve is closed at time t2, the amount of air supplied into the intake pipe decreases to around the amount during idling, and the intake pipe pressure P decreases near vacuum in the suction stroke. After the suction stroke finishes, the intake pipe pressure P gradually increases like during idling. However, the engine keeps a high speed rotation, thus the next suction stroke starts after the intake pipe pressure P only slightly increases, and the intake pipe pressure P rapidly decreases again.

Thus, when the throttle valve is closed to enter a deceleration state during the high speed rotation of the engine, a maximum value of the intake pipe pressure during one combustion cycle becomes extremely low unlike during idling in FIG. 2D. The state after time t2 in FIGS. 3A to 3C are a state where the engine is rotated by an external force, which requires no supply of fuel into the engine.

After the throttle valve is closed, and the rotational speed of the engine gradually decreases, as is apparent from the pulser output waveform in FIG. 3A, a time between a timing when each suction stroke finishes and a timing when the next suction stroke starts increases, thus the amount of air supplied into the intake pipe during one combustion cycle increases, and the maximum value of the intake pipe pressure P during one combustion cycle gradually increases. Then, when the rotational speed decreases to an idling speed, the waveform of the intake pipe pressure becomes the same as the waveform during idling, and the maximum value Pmax of the intake pipe pressure P becomes equal to the value during idling.

In FIG. 3C, a curve a in a wave line shows a change in the maximum value Pmax of the intake pipe pressure P.

Thus, in the single-cylinder four-cycle internal combustion engine, the change in the maximum value Pmax of the intake pipe pressure that occurs during one combustion cycle reflects a load state of the engine, and thus if an appropriate fuel cut start determination value PFCin and an appropriate fuel supply restart determination value PFCout are decided with respect to the maximum value Pmax of the intake pipe pressure that occurs during one combustion cycle, the intake pipe pressure becomes less than the fuel cut start determination value when the engine decelerates, and the intake pipe pressure reaches above the fuel supply restart determination value when the rotational speed of the engine decreases to the extent that the supply of the fuel needs to be restarted. Specifically, the fuel cut control is started at the timing when the maximum value Pmax of the intake pipe pressure becomes less than the fuel cut start determination value PFCin, and the supply of the fuel is restarted at the timing when the maximum value Pmax of the intake pipe pressure reaches above the fuel supply restart determination value PFCout, thereby allowing proper fuel cut control without detecting the opening degree of the throttle valve.

FIGS. 4A to 4C show a waveform of a pulse output Vs, a change in throttle valve opening degree $\alpha$, and a change in intake pipe pressure p with respect to time t, when the engine is decelerated while a vehicle is driving.

In an embodiment shown in FIGS. 4A to 4C, the throttle valve is gradually closed to a fully-closed state from a state of driving on a flat land at a rotational speed of 5000 r/min of the engine. As the throttle valve is gradually closed, the output of the engine decreases, and the rotational speed of the engine gradually decreases. The maximum value Pmax of the intake pipe pressure is first near the atmospheric pressure, but when the throttle valve is fully closed at time t1, the maximum value Pmax rapidly decreases, and becomes less than the fuel cut start determination value PFCin at time t2. At this time, the fuel injection control by the controller 2 is stopped to start the fuel cut control and stop the injection of the fuel from the injector.

When the fuel cut control is started, the rotational speed of the engine gradually decreases, and when the rotational speed decreases to about 1800 r/min, the maximum value Pmax of the intake pipe pressure reaches above the fuel supply restart determination value PFCout. At this time, the fuel injection control is restarted by the controller 2 to restart the supply of the fuel.

If the throttle valve is slightly opened when the throttle valve is in a fully-closed position during deceleration and the fuel cut control is performed, the maximum value Pmax of the intake pipe pressure P immediately increases to reach above the fuel supply restart determination value PFCout to restart the supply of the fuel.

In the above described embodiment, the throttle valve is returned to the fully-closed position (a position during idling) during deceleration. A timing chart showing an operation when the throttle valve is not returned to the fully-closed position during deceleration is shown in FIGS. 5A to 5C.

As shown in FIGS. 5A to 5C, when the throttle valve is not returned to the fully-closed position during deceleration (when the throttle valve is returned to a position slightly before the fully-closed position), the maximum value Pmax of the intake pipe pressure during deceleration does not become less than the fuel cut start determination value PFCin, and thus the fuel cut control is not performed.

The fuel supply restart determination value PFCout is set so as not to exceed the atmospheric pressure and so as to restart the supply of the fuel before the engine stalls.

The fuel cut start determination value PFCin is set so as to properly detect a deceleration state of the engine, and keep a value lower than the fuel supply restart determination value PFCout within a normal changing range of the atmospheric pressure in an operating environment.

Figure 6:
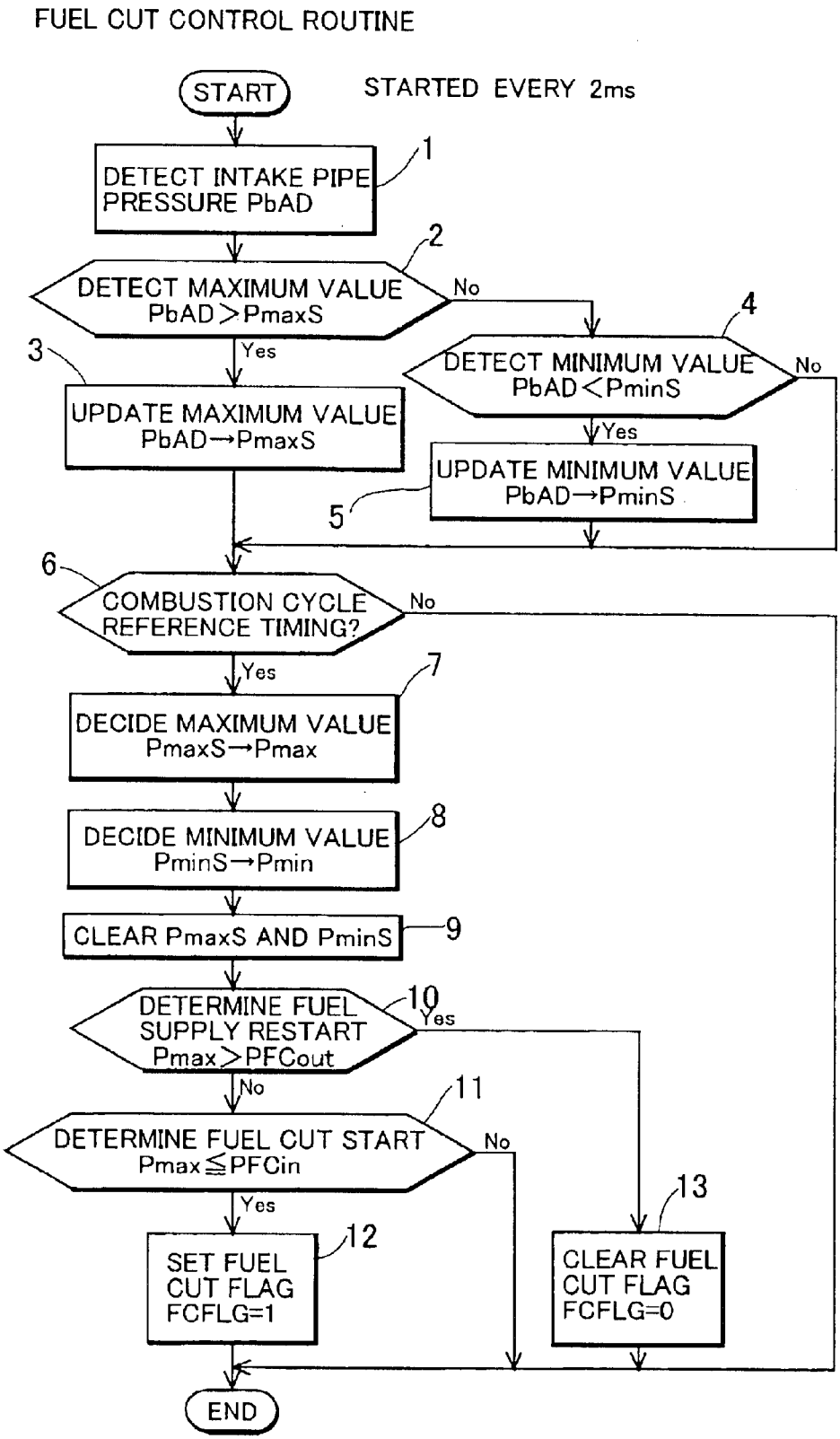
FIG. 6 is a flowchart of an embodiment of an algorithm of a program executed by a microprocessor in order to constitute an intake pipe pressure detection unit and a fuel cut/restart timing detection unit of a controller in FIG. 1.

A flowchart is shown in FIG. 6 of an algorithm of a fuel cut control routine of a program executed by the microprocessor of the controller in order to perform the control according to the invention.

The fuel cut control routine in FIG. 6 is executed every 2 msec, and in the routine, Steps 1 to 9 are processes of detecting the maximum value Pmax and the minimum value Pmin of the intake pipe pressure.

When the routine in FIG. 6 is started, in Step 1, an intake pipe pressure PbAD is detected, and it is determined in Step 2 whether the intake pipe pressure PbAD detected this time is a provisional maximum value PmaxS (whether it is higher than an intake pipe pressure detected last time). When it is determined that the intake pipe pressure detected this time is the provisional maximum value, the process proceeds to Step 3 to decide the intake pipe pressure PbAD detected this time as the provisional maximum value PmaxS of the intake pipe pressure.

When it is determined in Step 2 that the intake pipe pressure detected this time is not the maximum value, the process proceeds to Step 4, and it is determined whether the intake pipe pressure PbAD detected this time is a provisional minimum value PminS (whether it is lower than the intake pipe pressure detected last time). When it is determined that the intake pipe pressure detected this time is the provisional minimum value, the process proceeds to Step 5 to decide the intake pipe pressure PbAD detected this time as the provisional minimum value PminS of the intake pipe pressure.

After Step 3 or Step 5, Step 6 is performed, and it is determined whether a present timing is a reference timing of the combustion cycle. As the reference timing, for example, the timing when the pulser generates the first pulse Vs1 in the compression stroke is used. When it is not determined in Step 6 that the present timing is the reference timing, no further operation is performed to finish the routine.

When it is determined in Step 6 that the present timing is the reference timing, in Step 7, the present provisional maximum value is decided as a normal maximum value Pmax, in Step 8, the present provisional minimum value is decided as a normal minimum value Pmin, and then in Step 9, the provisional maximum value PmaxS and the provisional minimum value PminS are cleared.

In this embodiment, the intake pipe pressure maximum value detection unit in FIG. 1 is constituted by Steps 1, 2, 3, 6, 7 and 9.

After the maximum value of the intake pipe pressure is thus calculated, in Step 10, a fuel supply restart determination process of comparing the maximum value Pmax of the intake pipe pressure with the fuel supply restart determination value PFCout is performed. In this determination process, when it is determined that the maximum value Pmax of the intake pipe pressure is not higher than the fuel supply restart determination value PFCout, then in Step 11, a fuel cut start determination process of comparing the maximum value Pmax of the intake pipe pressure with the fuel cut start determination value PFCin is performed. When it is determined that the maximum value Pmax of the intake pipe pressure is equal to or lower than the fuel cut start determination value PFCin, the process proceeds to Step 12, and a fuel cut flag FCFLG is set to 1 to finish the routine. When it is determined in Step 11 that the maximum value Pmax of the intake pipe pressure is not equal to or lower than the fuel cut start determination value PFCin, no further operation is performed to finish the routine. When it is determined in Step 10 that the maximum value Pmax of the intake pipe pressure is higher than the fuel supply restart determination value PFCout, in Step 13, the fuel cut flag FCFLG is cleared to finish the routine.

In this embodiment, the fuel cut/restart timing detection unit 2D in FIG. 1 is constituted by Steps 10 to 13 in FIG. 6.

The fuel supply control unit 2E in FIG. 1 is comprised so as to monitor the fuel cut flag FCFLG, stop the control of the injector by the fuel injection control unit 2F when the fuel cut flag FCFLG is set to 1, and allows the control of the injector by the fuel injection control unit 2F when the fuel cut flag FCFLG is cleared.

In the embodiment, the fuel cut start determination value PFCin and the fuel supply restart determination value PFCout are fixed values, but if these determination values are fixed values, the following disadvantage may occur.

Specifically, in the case where the vehicle drives on uplands, which causes reduction in atmospheric pressure, if the fuel cut start determination value PFCin and the fuel supply restart determination value PFCout are set to fixed values appropriate for lowland driving when the above described control is performed, a difference between the atmospheric pressure and the fuel cut start determination value decreases during highland driving to cause frequent fuel cut control leading to an unstable operation of the engine. If the atmospheric pressure becomes equal to or lower than the fuel supply restart determination value, the supply of the fuel cannot be restarted, and the engine stalls.

In order to prevent such a situation, the controller 2 may further include determination value deciding means that decides the fuel cut start determination value and the fuel supply restart determination value depending on the atmospheric pressure detected by an atmospheric pressure detection unit 6, and use the fuel cut start determination value and the fuel supply restart determination value decided by the determination value deciding means in the fuel cut/restart timing detection unit 2D to detect the fuel cut control start timing and the fuel supply restart timing.

The atmospheric pressure detection unit 6 may be comprised so as to directly detect atmospheric pressure by an atmospheric pressure sensor, or to estimate atmospheric pressure from a waveform of the intake pipe pressure or an operation state of the engine.

Figure 7:
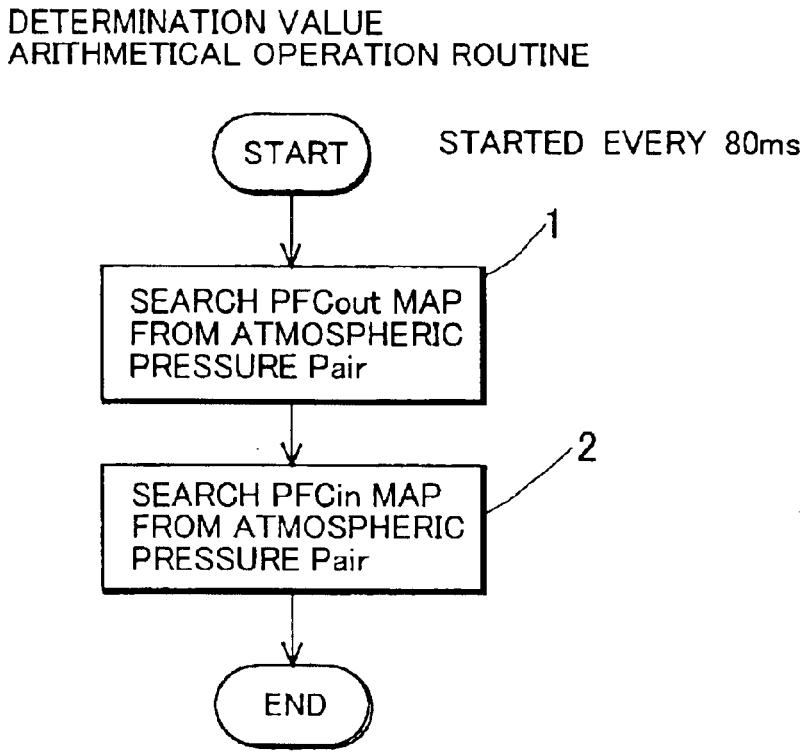
FIG. 7 is a flowchart of an embodiment of an algorithm of a program executed by the microprocessor, when a fuel cut start determination value and a fuel supply restart determination value are arithmetically operated depending on atmospheric pressure, in the control device in FIG. 1.

A flowchart is shown in FIG. 7 of an algorithm of a determination value arithmetical operation routine executed by the microprocessor of the controller in order to constitute the determination value deciding means. The determination value arithmetical operation routine in FIG. 7 is executed at relatively long intervals, for example, every 80 msec, and in this routine, in Step 1, a fuel supply restart determination value PFCout arithmetical operation map is searched for atmospheric pressure Pair to arithmetically operate the fuel supply restart determination value PFCout, and in Step 2, a fuel cut start determination value PFCin arithmetical operation map is searched for the atmospheric pressure Pair to arithmetically operate the fuel cut start determination value PFCin.

The fuel supply restart determination value PFCout is set so as to restart the supply of the fuel before the engine stalls, and to keep a value a substantially fixed value lower than the atmospheric pressure. An example of a relationship between the fuel supply restart determination value PFCout and the atmospheric pressure Pair is shown in FIG. 8.

As shown in FIG. 8, the fuel cut start determination value PFCin is set so as to represent a substantially fixed value when the atmospheric pressure is relatively high, and to decrease with the decrease in the atmospheric pressure in order to secure a difference from the fuel supply restart determination value PFCout in an area with an extremely low atmospheric pressure.

As is apparent from FIG. 8, when the fuel cut start determination value PFCin is the fixed value, the difference between the fuel cut start determination value PFCin and the fuel supply restart determination value PFCout becomes small in the area with the low atmospheric pressure, which causes a frequent repeat of fuel cut and restart of the fuel supply leading to an unstable operation of the engine. However, as shown in FIG. 8, the fuel cut start determination value PFCin is reduced with the decrease in the atmospheric pressure in the area with the low atmospheric pressure to increase the difference between the fuel supply restart determination value PFCout and the fuel cut start determination value PFCin, thereby preventing the frequent repeat of the fuel cut and the restart of the fuel supply.

The atmospheric pressure gradually changes, and in order to reduce a load on the microprocessor, the determination value arithmetical operation routine in FIG. 7 is executed at relatively long intervals (in the embodiment, every 80 msec).

In the embodiment, the single-cylinder internal combustion engine is taken as an example, but the invention can be applied to a multi-cylinder internal combustion engine that can detect an intake pipe pressure reflecting a change in throttle valve opening degree, that is, an independent intake multi-cylinder internal combustion engine having an intake pipe and a throttle valve for each cylinder. When the invention is applied to the independent intake multi-cylinder internal combustion engine, an intake pipe pressure maximum value detection unit may be comprised so as to detect a maximum value of a pressure in an intake pipe provided in any one of cylinders.

The invention can be applied to a multi-cylinder four-cycle internal combustion engine having one throttle valve for two cylinders.

FIG. 9 schematically shows a construction of a two-cylinder internal combustion engine having one throttle valve for two cylinders, and in FIG. 9, a reference numeral 10 denotes an engine body including a cylinder block and a cylinder head. A first cylinder #1 and a second cylinder #2 are provided in the engine body 10. A reference numeral 11 denotes an intake pipe, which has intake manifolds 11*a* and 11*b* connected at one end to the first cylinder and the second cylinder, respectively, and an intake collector 11*c* connected in common at one end to the other ends of the intake manifolds 11*a* and 11*b*. A throttle body 12 is connected to the other end of the intake collector 11*c*, and a throttle valve 13 is provided in the throttle body.

A reference numeral 14 denotes an exhaust pipe, which has exhaust manifolds 14*a* and 14*b* connected at one end to the first cylinder #1 and the second cylinder #2, respectively, and an exhaust collector 14*c* connected in common to the other ends of the manifolds.

Injectors 15*a* and 15*b* are mounted so as to inject fuel into the intake manifolds 11*a* and 11*b*, and an intake pressure sensor 16 is mounted so as to measure an intake pipe pressure at the intake collector 11*c*.

In the internal combustion engine in FIG. 9, a waveform of the intake pipe pressure detected by the intake pressure sensor 16 is as shown in FIGS. 10A and 10B. Specifically, the intake pipe pressure represents a maximum value Pmax immediately before a suction stroke, and represents a minimum value Pmin before the suction stroke finishes.

Therefore, also in the multi-cylinder internal combustion engine having one throttle valve for two cylinders, the fuel cut control is started when the maximum value Pmax of the intake pipe pressure that occurs during one combustion cycle becomes less than the fuel cut start determination value, and the supply of the fuel to the engine is restarted when the maximum value of the intake pipe pressure exceeds the fuel supply restart determination value, thereby allowing the fuel cut control.

In the embodiment in FIG. 9, the intake pipe pressure is detected in the collector 11*c* of the intake pipe, but may be detected in the intake manifold 11*a* or 11*b*.

In the embodiment, the fuel injection device is used as means for supplying fuel to the engine, but the invention may be applied to the case when a carburetor is used as means for supplying fuel to the engine.

As described above, according to the invention, in the single cylinder or multi-cylinder four-cycle internal combustion engine having the throttle valve for each cylinder, or the multi-cylinder four-cycle internal combustion engine having one throttle valve for two cylinders, noting that the change in the maximum value of the intake pipe pressure that occurs during one combustion cycle reflects the load state of the engine, the fuel cut control is started when the maximum value of the intake pipe pressure that occurs during one combustion cycle becomes less than the fuel cut start determination value, and the supply of the fuel to the engine is restarted when the maximum value of the intake pipe pressure exceeds the fuel supply restart determination value, thereby allowing the fuel cut control without using an expensive throttle sensor.

Although some preferred embodiments of the invention have been described and illustrated with reference to the accompanying drawings, it will be understood by those skilled in the art that they are by way of example, and that various changes and modifications may be made without departing from the spirit and scope of the invention, which is defined only to the appended claims.

What is claimed is:

1. A fuel cut control device for an internal combustion engine comprising a controller that performs a fuel cut control to stop supply of fuel to said internal combustion engine during deceleration of said internal combustion engine, wherein said controller is comprised so as to detect a maximum value of an intake pipe pressure during one combustion cycle of said internal combustion engine, start said fuel cut control when it is detected that the detected maximum value of the intake pipe pressure becomes less than a set fuel cut start determination value, and stop said fuel cut control when it is detected that the detected maximum value of the intake pipe pressure exceeds a fuel supply restart determination value set higher than said fuel cut start determination value to restart the supply of the fuel to said internal combustion engine.

2. A fuel cut control device for an internal combustion engine comprising a controller that performs a fuel cut control to stop supply of fuel to said internal combustion engine during deceleration of a single-cylinder or multi-cylinder internal combustion engine having a throttle valve for each cylinder, wherein said controller is comprised so as to detect a maximum value of an intake pipe pressure during one combustion cycle of said internal combustion engine, start said fuel cut control when it is detected that the detected maximum value of the intake pipe pressure becomes less than a set fuel cut start determination value, and stop said fuel cut control when it is detected that the detected maximum value of the intake pipe pressure exceeds a fuel supply restart determination value set higher than said fuel cut start determination value to restart the supply of the fuel to said internal combustion engine.

3. A fuel cut control device for an internal combustion engine comprising a controller that performs fuel cut control to stop supply of fuel to said internal combustion engine during deceleration of a multi-cylinder internal combustion engine having one throttle valve for two cylinders, wherein said controller is comprised so as to detect a maximum value of an intake pipe pressure during one combustion cycle of said internal combustion engine, start said fuel cut control when it is detected that the detected maximum value of the intake pipe pressure becomes less than a set fuel cut start determination value, and stop said fuel cut control when it is detected that the detected maximum value of the intake pipe pressure exceeds a fuel supply restart determination value set higher than said fuel cut start determination value to restart the supply of the fuel to said internal combustion engine.

4. A fuel cut control device for an internal combustion engine comprising a controller that performs a fuel cut control to stop supply of fuel to said internal combustion engine during deceleration of a single-cylinder or multi-cylinder internal combustion engine having a throttle valve for each cylinder, wherein said controller comprises:

an intake pipe pressure maximum value detection unit that detects a maximum value of an intake pipe pressure during one combustion cycle of said internal combustion engine;

a fuel cut/restart timing detection unit that detects a timing when the maximum value of the intake pipe pressure detected by said intake pipe pressure maximum value detection unit becomes less than a set fuel cut start determination value, as a fuel cut control start timing when said fuel cut control is started, and detects a timing when the maximum value of the intake pipe pressure detected by said intake pipe pressure maximum value detection unit exceeds a fuel supply restart determination value set higher than said fuel cut start determination value, as a fuel supply restart timing when said fuel cut control is stopped to restart the supply of the fuel to said internal combustion engine; and a fuel supply control unit that controls the supply of the fuel to said internal combustion engine so as to start said fuel cut control when said fuel cut/restart timing detection unit detects said fuel cut control start timing, and restart the supply of the fuel to said internal combustion engine when said fuel supply restart timing is detected.

5. The fuel cut control device for an internal combustion engine according to claim 4, further comprising an atmospheric pressure detection unit that detects atmospheric pressure, wherein said controller further comprises determination value deciding means that decides said fuel cut start determination value and said fuel supply restart determination value depending on an atmospheric pressure value detected by said atmospheric pressure detection unit.

6. The fuel cut control device for an internal combustion engine according to claim 4, further comprising an atmospheric pressure estimation unit that estimates the atmospheric pressure from said intake pipe pressure, wherein said controller further comprises determination value deciding means that decides said fuel cut start determination value and said fuel supply restart determination value depending on an atmospheric pressure value estimated by said atmospheric pressure estimation unit.

7. A fuel cut control device for an internal combustion engine comprising a controller that performs a fuel cut control to stop supply of fuel to said internal combustion engine during deceleration of a multi-cylinder having one throttle valve for two cylinders, wherein said controller comprises:

an intake pipe pressure maximum value detection unit that detects a maximum value of an intake pipe pressure during one combustion cycle of said internal combustion engine;

a fuel cut/restart timing detection unit that detects a timing when the maximum value of the intake pipe pressure detected by said intake pipe pressure maximum value detection unit becomes less than a set fuel cut start determination value, as a fuel cut control start timing when said fuel cut control is started, and detects a timing when the maximum value of the intake pipe pressure detected by said intake pipe pressure maximum value detection unit exceeds a fuel supply restart determination value set higher than said fuel cut start determination value, as a fuel supply restart timing when said fuel cut control is stopped to restart the supply of the fuel to said internal combustion engine; and a fuel supply control unit that controls the supply of fuel to said internal combustion engine so as to start said fuel cut control when said fuel cut/restart timing detection unit detects said fuel cut control start timing, and restart the supply of the fuel to said internal combustion engine when said fuel supply restart timing is detected.

8. The fuel cut control device for an internal combustion engine according to claim 7, further comprising an atmospheric pressure measurement unit that measures atmospheric pressure, wherein said controller further comprises determination value deciding means that decides said fuel cut start determination value and said fuel supply restart determination value depending on an atmospheric pressure value measured by said atmospheric pressure measurement unit.

9. The fuel cut control device for an internal combustion engine according to claim 7, further comprising an atmospheric pressure estimation unit that estimates the atmospheric pressure from said intake pipe pressure, wherein said controller further comprises determination value deciding means that decides said fuel cut start determination value and said fuel supply restart determination value depending on an atmospheric pressure value estimated by said atmospheric pressure estimation unit.

* * * * *